US005108519A

United States Patent [19]

Armanie et al.

[11] Patent Number: 5,108,519

[45] Date of Patent: Apr. 28, 1992

[54] ALUMINUM-LITHIUM ALLOYS SUITABLE FOR FORGINGS

[75] Inventors: Kevin P. Armanie, Penn Hills, Pa.; G. William Kuhlman, Shaker Heights, Ohio; Roberto J. Rioja, Lower Burrell; Amiya K. Chakrabarti, Monroeville, both of Pa.

[73] Assignee: Aluminum Company of America, Pittsburgh, Pa.

[21] Appl. No.: 542,760

[22] Filed: Jun. 15, 1990

Related U.S. Application Data

[63] Continuation-in-part of Ser. No. 149,802, Jan. 28, 1988.

[51] Int. Cl.[5] ..... C22F 1/04; C22C 21/12

[52] U.S. Cl. ..... 148/12.7 A; 148/11.5 A; 148/159; 148/439; 420/532

[58] Field of Search ..... 148/11.5 A, 159, 439, 148/12.7 A; 420/532, 535, 545

[56] References Cited

U.S. PATENT DOCUMENTS

| | | | |
|---|---|---|---|
| 2,915,390 | 12/1959 | Criner | 75/141 |
| 4,094,705 | 6/1978 | Sperry et al. | 148/2 |
| 4,571,272 | 2/1986 | Grimes | 148/11.5 |
| 4,582,544 | 4/1986 | Grimes et al. | 148/11.5 |
| 4,603,029 | 7/1986 | Quist et al. | 420/535 |
| 4,626,409 | 12/1986 | Miller | 420/533 |
| 4,636,357 | 1/1987 | Peel et al. | 420/532 |
| 4,648,913 | 3/1987 | Hunt, Jr. et al. | 148/12.7 |
| 4,816,087 | 3/1989 | Cho | 148/11.5 A |
| 4,961,792 | 10/1990 | Rioja et al. | 148/12.7 A |

FOREIGN PATENT DOCUMENTS

| | | |
|---|---|---|
| 150456 | 8/1985 | European Pat. Off. . |
| 156995 | 10/1985 | European Pat. Off. . |
| 158769 | 10/1985 | European Pat. Off. . |
| 210112 | 6/1986 | European Pat. Off. . |
| 3613224 | 4/1986 | Fed. Rep. of Germany . |
| 1387586 | 3/1975 | United Kingdom . |
| 2127847 | 3/1986 | United Kingdom . |
| 8502416 | 11/1984 | World Int. Prop. O. . |

OTHER PUBLICATIONS

"Microstructure and Toughness of High Strength Aluminum Alloys", by J. T. Staley, ASTM STP 605, pp. 71-103.

*Primary Examiner*—R. Dean
*Assistant Examiner*—Robert R. Koehler
*Attorney, Agent, or Firm*—Andrew Alexander

[57] ABSTRACT

Disclosed is a process for forming a recrystallized forged product having low anisotropy or unrecrystallized forged products having high strength comprising providing a body of a lithium-containing aluminum base alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr in the range of 0.01 to 0.2 wt. %, Mn, Ni, Fe and Ag in the range of 0.01 to 1 wt. % and Hf, Sc and In in the range of 0.01 to 0.5 wt. %.

48 Claims, 2 Drawing Sheets

ANISOTROPY (L-LT) OF FORGINGS

ALUMINUM-LITHIUM ALLOYS SUITABLE FOR FORGINGS

CROSS REFERENCE TO RELATED APPLICATIONS

This application is a continuation-in-part of U.S. Ser. No. 149,802, filed Jan. 28, 1988.

BACKGROUND OF THE INVENTION

This invention relates to aluminum base alloys, and more particularly, it relates to improved lithium containing aluminum base alloys, products made therefrom and methods of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made However, the addition of lithium to aluminum alloys is not without problems. For example, the addition of lithium to aluminum alloys often results in a decrease in ductility and fracture toughness Where the use is in aircraft parts, it is imperative that the lithium containing alloy have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

U.S. Pat. No. 4,626,409 discloses aluminum base alloy consisting of, by wt. %, 2.3 to 2.9 Li, 0.5 to 1 Mg, 1.6 to 2.4 Cu, 0.05 to 0.25 Zr, 0 to 0.5 Ti, 0 to 0.5 Mn, 0 to 0.5 Ni, 0 to 0.5 Cr and 0 to 2 Zn and a method of producing sheet or strip therefrom. In addition, U.S. Pat. No. 4,582,544 discloses a method of superplastically deforming an aluminum alloy having a composition similar to that of U.S. Pat. No. 4,626,409. European Patent Application 210112 discloses an aluminum alloy product containing 1 to 3.5 wt. % Li, up to 4 wt. % Cu, up to 5 wt. % Mg, up to 3 wt. % Zn and Mn, Cr and/or Zr additions. The alloy product is recrystallized and has a grain size less than 300 micrometers. U.S. Pat. No. 4,648,913 discloses aluminum base alloy wrought product having improved strength and fracture toughness combinations when stretched, for example, an amount greater than 3%.

The present invention provides an improved lithium containing aluminum base alloys which permit products having improved strength characteristics while retaining high toughness properties and low anisotropy.

SUMMARY OF THE INVENTION

A principal object of this invention is to provide an improved lithium containing aluminum base alloys.

Another object of this invention is to provide an improved aluminum-lithium alloy wrought product having improved corrosion resistance, strength and toughness characteristics.

And yet another object of this invention includes providing lithium containing aluminum base alloy suitable for forged products having improved strength and fracture toughness properties and low anisotropy.

These and other objects will become apparent from the specification, drawings and claims appended hereto.

In accordance with these objects, an aluminum base alloy suitable for forming into a wrought product having improved corrosion resistance and combinations of strength and fracture toughness is provided. The alloy is comprised of 0.2 to 5 wt. % Li, 0.05 to 6 wt. % Mg, 0.2 to 4 wt. % Cu, 0.05 to 0.12 wt. % Zr, 0.05 to 12 wt. % Zn, 0.5 wt. % max. Fe, 0.5 wt. % max. Si, the balance aluminum and incidental impurities.

DETAILED DESCRIPTION OF THE PREFERRED EMBODIMENTS

Figure 1:
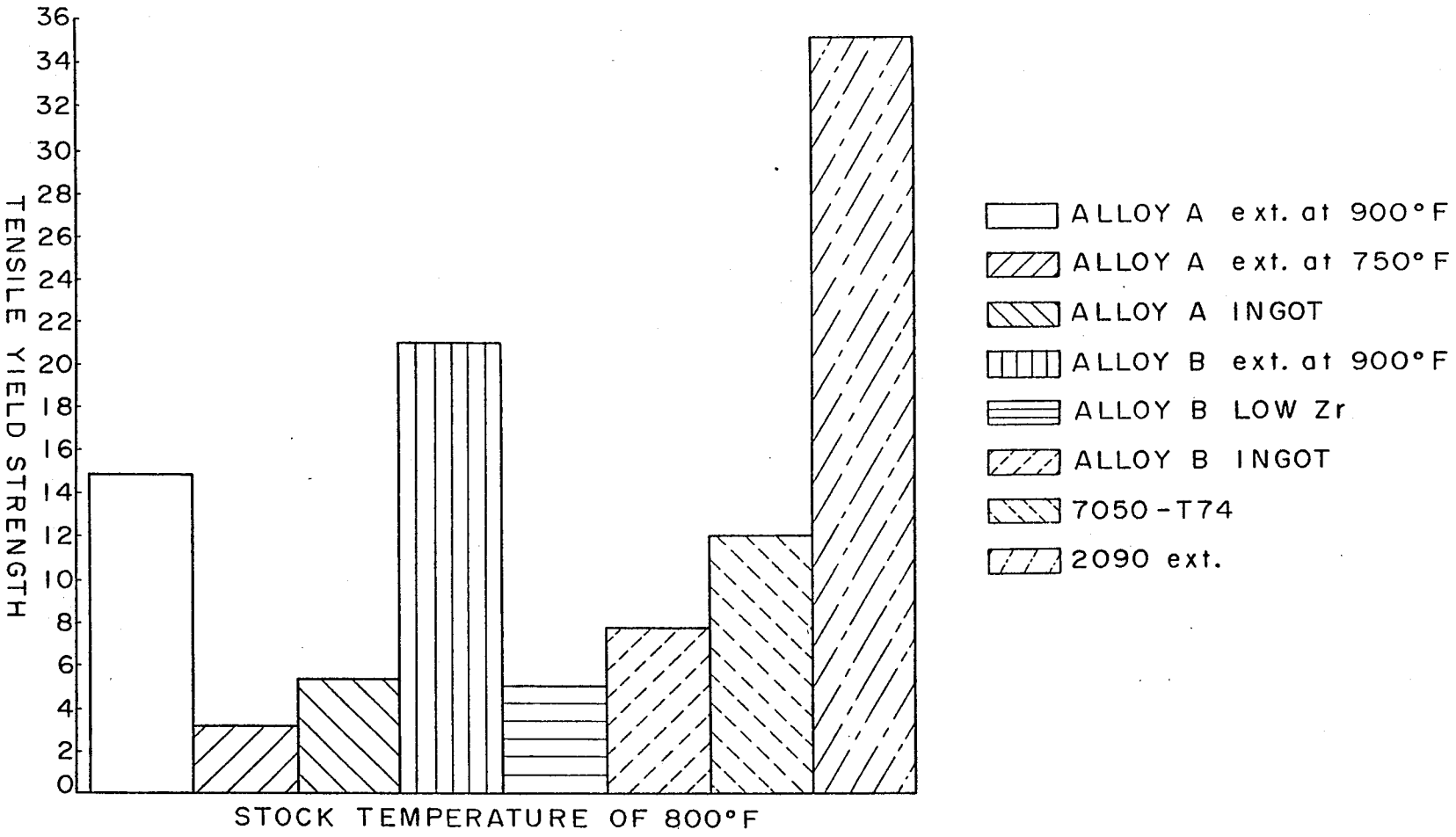
FIG. 1 shows the anisotropy of forgings made from Alloys A and B of the invention compared to AA7050-T74 and AA2090. Alloy A has the following composition: 2.2 wt. % Li, 2.7 wt. % Cu, 0.7 wt. % Zn, 0.3 wt. % Mg, 0.4 wt. % Mn, 0.03 wt.% Fe, 0.04 wt. % Si, 0.02 wt. % Zr, the balance aluminum. Alloy B has the following composition: 2.2 wt. % Li, 2.7 wt. % Cu, 0.7 wt. % Zn, 0.3 wt. % Mg, 0.03 wt. % Fe, 0.04 wt. % Si, 0.12 wt. % Zr, the balance aluminum.

The alloy of the present invention can contain 0.2 to 5 wt. % Li, 0.5 to 6 wt. % Mg, at least 2.45 wt. % Cu, 0.05 to 12 wt. % Zn, 0.01 to 0.14 wt. % Zr, 1 wt. % Fe, 0.5 wt. % max. Si, the balance aluminum and incidental impurities. The impurities are preferably limited to about 0.05 wt. % each, and the combination of impurities preferably should not exceed 0.35 wt. %. Within these limits, it is preferred that the sum total of all impurities does not exceed 0.15 wt. %.

A preferred alloy in accordance with the present invention can contain 1.5 to 3 wt. % Li, 2.5 to 2.95 wt. % Cu, 0.2 to 2.5 wt. % Mg, 0.2 to 11 wt. % Zn, 0.08 to 0.12 wt. % Zr, the balance aluminum and impurities as specified above. A typical alloy composition would contain 1.8 to 2.5 wt. % Li, 2.55 to 2.9 wt. % Cu, 0.2 to 2 wt. % Mg, 0.2 to 2 wt. % Zn, greater than 0.1 to less than 0.16 wt. % Zr, and max. 0.1 wt. % of each of Fe and Si, the remainder aluminum.

A suitable alloy composition would contain 1.9 to 2.4 wt. % Li, 2.55 to 2.9 wt. % Cu, 0.1 to 0.6 wt. % Mg, 0.5 to 1 wt. % Zn, 0.08 to 0.12 wt. % Zr, max. 0.1 wt. % of each of Fe and Si, the remainder aluminum.

Certain preferred alloys contain 1.8 to 3 wt. % Li, 2.4 to 3 wt. % Cu, 0 to 0.15 wt. % Zr and 0.05 to 1 wt. % Ag, the remainder aluminum and incidental elements and impurities. Another alloy of this category can contain 1.8 to 3 wt. % Li, 2.4 to 3 wt. % Cu, 0 to 0.15 wt. % Zr and 0.01 to 0.5 wt. % In, the remainder aluminum and impurities. A further composition of this category of alloy can contain 1.8 to 3 wt. % Li, 2.4 to 3 wt. % Cu, 0 to 0.15 wt. % Zr, 0.1 to 2 wt. % Zn or 0.05 to 6 wt. % Mg, the remainder aluminum, incidental elements and impurities.

Another preferred alloy in accordance with the invention can contain 1.2 to 4 wt. % Li, 0.2 to 4.5 wt. % Cu, 0.2 to 2.5 wt. % Mg, 0.2 to 11 wt. %, typically 2.1 to 10 wt. % Zn, 0.01 to 1 wt. % Ag, 0.01 to 15 wt. % Zr, 1 wt. % max. Fe, 0.5 wt. % Si, the remainder aluminum and incidental elements and impurities.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the limits of copper, since excessive amounts, for example, can lead to the undesirable formation of intermetallics which can interfere with fracture toughness. Typically, copper should be less than 3 wt. %; however, in a less preferred embodiment, copper can be increased to less than 4 wt. % and preferably less than 3.5 wt. %. The combination of lithium and copper should not exceed 5.5 wt. % with lithium being at least 1.5 wt. % with greater amounts of lithium being preferred.

Magnesium is added or provided in this class of aluminum alloys mainly for purposes of increasing strength although it does decrease density slightly and is advantageous from that standpoint. It is important to adhere to the limits set forth for magnesium because excess magnesium, for example, can also lead to interference with fracture toughness, particularly through the formation of undesirable phases at grain boundaries.

Grain structure control materials and additional strengthening elements include Zr, Cr, V, Hf, Sc, Mn, Ti, Ni, Fe, Ag and In, with Cr, V, Ti and Zr in the range of 0.01 to 0.2 wt. %, Mn, Ni, Fe and Ag 0.01 to 1 wt. % and In, Hf and Sc in the range of 0.01 to 0.5 wt. %. The level of Zr used depends on whether a recrystallized or unrecrystallized structure is desired. The use of zinc results in increased levels of strength, particularly in combination with magnesium and/or Ag. However, excessive amounts of zinc can impair toughness through the formation of intermetallic phases. Mn, Cr, V, Fe and Ni are incoherent dispersoid-forming elements which also add to the strength of the alloy product without cold work. By incoherent dispersoid is meant the planes of the matrix and precipitated phase, e.g., dispersoid, do not line up.

Zinc is important because, in this combination with magnesium, it results in an improved level of strength which is accompanied by high levels of corrosion resistance when compared to alloys which are zinc free. Particularly effective amounts of Zn are in the range of 0.1 to 1 wt. % when the magnesium is in the range of 0.05 to 0.5 wt. %, as presently understood. It is important to keep the Mg and Zn in a ratio in the range of about 0.1 to less than 1 when Mg is in the range of 0.1 to 1 wt. % with a preferred ratio being in the range of 0.2 to 0.9 and a typical ratio being in the range of about 0.3 to 0.8. The ratio of Mg to Zn can range from 1 to 6 when the wt. % of Mg is 1 to 4 and Zn is controlled to 0.2 to 2 wt. %, preferably in the range of 0.2 to 0.9 wt. %.

Working with the Mg/Zn ratio of less than one is important in that it aids in the worked product being less anisotropic or being more isotropic in nature, i.e., properties more uniform in all directions. That is, working with the Mg/Zn ratio in the range of 0.2 to 0.8 can result in the end product having greatly reduced hot worked texture, resulting from rolling, for example, to provide improved properties, for example in the 45° direction.

Toughness or fracture toughness as used herein refers to the resistance of a body, e.g. extrusions, forgings, sheet or plate, to the unstable growth of cracks or other flaws.

The Mg/Zn ratio less than one is important for another reason. That is, keeping the Mg/Zn ratio less than one, e.g., 0.5, results not only in greatly improved strength and fracture toughness but in greatly improved corrosion resistance. For example, when the Mg and Zn content is 0.5 wt. % each, the resistance to corrosion is greatly lowered. However, when the Mg content is about 0.3 wt. % and the Zn is 0.5 wt. %, the alloys have a high level of resistance to corrosion.

While the inventors do not wish to be held to any theory of invention, it is believed that the resistance to exfoliation and the resistance to crack propagation under an applied stress increases as Zn is added. It is believed that this behavior is due to the fact that Zn stimulates the desaturation of Cu from the matrix solid solution by enhancing the precipitation of Cu-rich precipitates. This effect is believed to change the solution potential to higher electronegative values. It is also believed that Zn forms Mg-Zn bearing phases at the grain boundaries that interact with propagating cracks and blunt the crack tip or deflect the advancing crack and thereby improves the resistance to crack propagation under an applied load.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about 0.25 to 2 or 3 inches or more depending on the end product desired. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li, Cu, Zn and Mg and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable.

After the homogenizing treatment, the metal can be rolled or extruded or otherwise subjected to working operations to produce stock such as plate or extrusions or other stock suitable for shaping into the end product as by forging, for example. To produce a plate-type product, a body of the alloy is preferably hot rolled to a thickness ranging from 0.25 to 6 inches. For hot rolling purposes, the temperature should be in the range of 1000° F. down to 750° F. Preferably, the metal temperature initially is in the range of 850° to 975° F.

Figure 2:
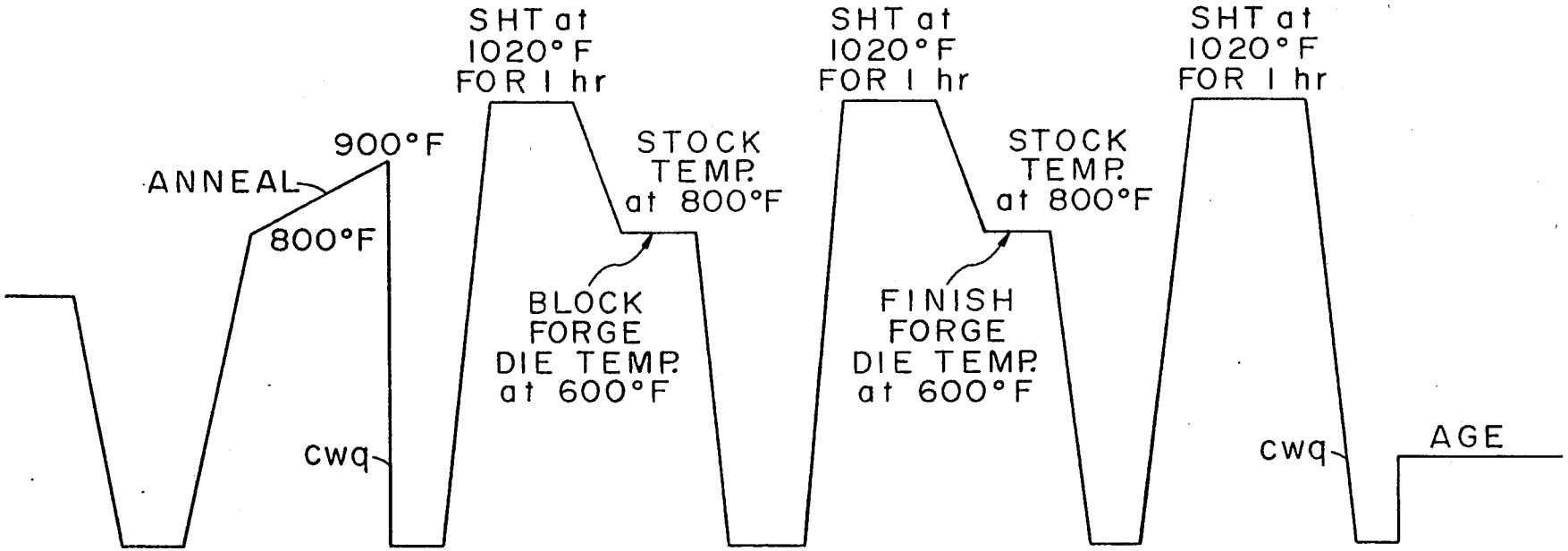
FIG. 2 shows processing steps to provide forged products in accordance with the invention.

When the intended use of the alloy is a forged product, e.g., an open die or closed die forging, having low anisotropy, then an ingot or body of the alloy may be worked, e.g., rolled or extruded, to provide a preform having a recrystallized structure. Or alternatively, the ingot or body may be machined to provide a preform suitable for forging. The preforming operation may include drawing. By the use of preforming herein is meant to include working, drawing, extruding or machining, for example, to provide the body in shape or condition suitable for forging. For purposes of extruding, it is preferred to keep the temperature of the ingot at less than 900° F. and typically in the range of about 500° to 875° F. with a suitable range being 650° to 825° F. (FIG. 2). These ranges result in a forged product having low anisotropy, e.g., lower than 15 ksi. If an unrecrystallized structure is desired in the preform, the extruding temperature can be 900° F. or higher. However, the product may have high levels of anisotropy which may be desirable if high strength in one direction is needed.

After the preforming step, the product can be solution heat treated prior to a first or block forging operation. By block forging is meant operations which preliminarily work or shape the product. The solution heat treatment can range from 900° to 1050° F. and typically 950° to 1030° F. for a time of at least 0.5 hours and preferably at least 0.75 hours with longer times not harmful. Thereafter, the preformed product temperature is maintained in the range of 600° to 1000° F., preferably 750° to 900° F. for block forging. The temperature of the preformed product may be maintained at about 600° to 850° F., for example, by heating the dies to at least about 600° F.

The block forged product may be subjected to a second solution heat treating and forging operation at the same conditions as noted above. The product resulting therefrom may be referred to as a finished forging.

Thereafter, the finished forging may be subjected to a ramp anneal and solution heat treatment, followed by quenching, e.g., cold or warm water quench and aging.

The ramp anneal referred to is an annealing treatment wherein annealing temperature is increased with time of anneal. In the anneal practice, the starting temperature can be as high as 750° to 850° F. and then increased with anneal time to temperatures higher than 750° F. or 850° F. up to 950° F., for example. With respect to higher starting temperatures, a typical starting temperature is 800° F. and the temperature can then be increased with time to about 900° F. When lower ramp anneal temperatures are used, starting temperatures do not usually exceed 550° F., normally 400° F., with a typical starting temperature being in the range of 350° to 450° F. and an ending temperature being in the range of 650° to 850° F. Typical ending temperatures are in the range of 850° to 950° F., depending on the alloy composition. A suitable ramp anneal for the alloy starts at 800° F. and ends at 900° F. In the ramp anneal, the temperature can be increased at a rate of 2 to 100°/hr, and preferably at a rate of 5 to 80°/hr. The time from the beginning to the end of the ramp anneal can range from 3 to about 10 hours, with typical times being in the range of 2 to 8 hours. The ramp anneal can include a series of increases in temperature with a holding time at temperature plateau or series of plateaus. Further, it can include even increases in temperature followed by decreases in temperature until the final ending temperature is reached. Also, there may be even holding plateaus at any one or more temperature level. It will be understood that in some cases, as the anneal temperature increases, an independent solution heat treatment may not be necessary but, instead, is included as part of the ramp anneal or is an extension of the ramp anneal. The product may be cooled after the ramp anneal and a separate solution heat treatment, quench and aging performed.

The solution heat treatment can be the same as referred to hereinabove. Aging of the forged product can be 350° F. for 25 hours, for example. In its broader aspects, aging can be accomplished by subjecting the forged part to a temperature in the range of 150° to 400° F. for a sufficient period of time to further increase the yield strength. The useful strengths which can be achieved are in the range of 50 to 85 ksi. Preferably, artificial aging is accomplished by subjecting the alloy product to a temperature in the range of 275° to 375° F. for a period of at least 30 minutes. A suitable aging practice contemplates a treatment of about 8 to 35 hours at a temperature of about 350° F. Further, it will be noted that the alloy product in accordance with the present invention may be subjected to any of the typical underaging treatments well known in the art, including natural aging and multi-step agings. Also, while reference has been made herein to single aging steps, multiple aging steps, such as two or three aging steps, are contemplated and compression or its equivalent working may be used prior to or even after part of such multiple aging steps.

In another aspect of the invention, the solution heat treating steps may be eliminated prior to the forging steps. However, the ultimate tensile strength can be lower, particularly in the short transverse direction and 45° direction and anisotropy is increased. Further, the ramp annealing may be eliminated as well as the solution heat treating steps but again the tensile properties suffer.

In a further aspect of the invention, after the extrusion step, the product can be subjected to the ramp annealing (FIG. 2). Thus, ramp annealing operation is performed before the forging step instead of after forging steps with satisfactory tensile properties and anisotropy. In this situation, it is preferred to solution heat treat before the forging step. If the solution heat treating steps are not retained, then the strength properties suffer and anisotropy becomes higher.

Wrought products, e.g., forgings, in accordance with the present invention develop a solid state precipitate along the (100) family of planes. The precipitate is plate like and has a diameter in the range of about 50 to 100 Angstroms and a thickness of 4 to 20 Angstroms. The precipitate is primarily copper or copper-magnesium containing; that is, it is copper or copper-magnesium rich. These precipitates are generally referred to as GP zones and are referred to in a paper entitled "The Early Stages of GP Zone Formation in Naturally Aged Al-4 Wt Pct Cu Alloys" by R. J. Rioja and D. E. Laughlin, *Metallurgical Transactions A.* Vol. 8A, Aug. 1977, pp. 1257–61, incorporated herein by reference. It is believed that the precipitation of GP zones results from the addition of Mg and Zn which is believed to reduce solubility of Cu in the Al matrix. Further, it is believed that the Mg and Zn stimulate nucleation of this metastable strengthening precipitate. The number density of precipitates on the (100) planes per cubic centimeter ranges from $1\times10^{15}$ to $1\times10^{17}$ with a preferred range being higher than $1\times10^{15}$ and typically as high as $5\times10^{16}$. These precipitates aid in producing a high level of strength without losing fracture toughness, particularly if short aging times, e.g., 15 hours at 350° F., are used for unstretched products.

Forged product of the present invention suitably includes aircraft wheels, spacecraft and aircraft frame members, for example, which are particularly suitable for the forging operation.

The following examples are further illustrative of the invention:

EXAMPLE 1

An alloy having 2.1 wt. % Li, 2.7 wt. % Cu, 0.4 wt. % Mg, 0.9 wt. % Zn, 0.4 wt. % Mn, 0.04 wt. % V and 0.02 wt. % Zr was formed into an ingot which was then homogenized and then extruded at 750° F. and permitted to air cool. The extruded bar stock was die-forged using a set of blocking and finishing die. The blocking die forging operation produces an intermediate shape which is forged again in the finisher or finishing die to get the desired near-net forging geometry. The forging in this example was conducted by solution heat treating the extruded product at 1020° F. for 2 hours followed by air cooling to 800° F. and block forging at 800° F. with dies heated to 600° F. The blocker forging was air cooled to room temperature. The blocker forging was resolution treated and air cooled to 800° F., finish forged and then air cooled. The finish forged product was then heated to 800° F. and ramp annealed to 900° F. over a period of 8 hours. Thereafter, the temperature was raised to 1020° F. and held there for 2 hours and then the product was cold water quenched. The product was then aged at 350° F. for 25 hours and exhibited a recrystallized structure. The properties are set forth in Table I.

TABLE I

| | Mechanical Properties | | | |
|---|---|---|---|---|
| Orientation | UTS (ksi) | TYS (ksi) | Fracture Toughness (ksi sq.rt.in.) | % elong. |
| 1-L | 74.8 | 64.5 | LT-1 27.2 | 4.7 |
| 2-L | 77.1 | 66.8 | LT-2 22.4 | 4.7 |
| 1-ST | 64.2 | 63.0 | TL-1 19.9 | 3.1 |
| 2-ST | 70.3 | 61.3 | TL-2 17.1 | 4.7 |
| 3-ST | 67.1 | 65.5 | | 3.1 |
| 1-45 | 68.3 | 62.2 | 1-45 20.8 | 3.1 |
| 2-45 | 72.0 | 68.0 | 2-45 17.9 | 3.1 |

EXAMPLE 2

This example was the same as Example 1 except the solution heat treatment was eliminated before the block forging and finish forging steps. The resulting properties are shown in Table II.

TABLE II

| | Mechanical Properties | | | |
|---|---|---|---|---|
| Orientation | UTS (ksi) | TYS (ksi) | Fracture Toughness (ksi sq.rt.in.) | % elong. |
| 1-L | 72.3 | 65.4 | LT-1 26.6 | 3.1 |
| 2-L | 69.3 | 63.2 | LT-2 25.5 | 3.1 |
| 1-ST | 62.4 | 59.2 | TL-1 17.0 | 4.7 |
| 2-ST | 65.0 | 65.0 | TL-2 20.0 | 3.1 |
| 3-ST | 65.5 | 65.5 | | 3.1 |
| 1-45 | 63.3 | 63.3 | 1-45 17.2 | 4.7 |
| 2-45 | 62.2 | 57.7 | 2-45 21.0 | 4.7 |

EXAMPLE 3

This example was the same as Example 2 except the ramp anneal was eliminated before the solution heat treatment. The resulting properties are shown in Table III.

TABLE III

| | Mechanical Properties | | | |
|---|---|---|---|---|
| Orientation | UTS (ksi) | TYS ksi) | Fracture Toughness (ksi sq.rt.in.) | % elong. |
| 1-L | 68.8 | 60.2 | LT-1 26.5 | 4.7 |
| 2-L | 70.9 | 61.6 | LT-2 26.3 | 3.1 |
| 1-ST | 64.2 | 63.8 | TL-1 19.7 | 2.3 |
| 2-ST | 64.6 | 60.9 | TL-2 19.4 | 3.1 |
| 3-ST | 65.1 | 59.4 | | 3.1 |
| 1-45 | 64.4 | 60.2 | 1-45 19.2 | 3.1 |
| 2-45 | 66.5 | 60.8 | 2-45 20.1 | 3.1 |

EXAMPLE 4

This example was the same as Example 1 except the ramp anneal was applied immediately after the extruding step and followed by a cold water quench. The resulting properties are shown in Table IV.

TABLE IV

| | Mechanical Properties | | | |
|---|---|---|---|---|
| Orientation | UTS (ksi) | TYS (ksi) | Fracture Toughness (ksi sq.rt.in.) | % elong. |
| 1-L | 73.9 | 66.9 | LT-1 24.9 | 4.7 |
| 2-L | 74.9 | 66.7 | LT-2 22.2 | 4.7 |
| 1-ST | 68.6 | 68.6 | TL-1 21.9 | 2.3 |
| 2-ST | 71.2 | 63.4 | TL-2 20.6 | 3.1 |
| 3-ST | 65.3 | 60.5 | | 4.7 |

TABLE IV-continued

| Orientation | Mechanical Properties UTS (ksi) | TYS (ksi) | Fracture Toughness (ksi sq.rt.in.) | % elong. |
|---|---|---|---|---|
| 1-45 | 67.8 | 62.5 | 1-45 23.5 | 4.7 |
| 2-45 | 68.1 | 62.8 | 2-45 18.2 | 4.7 |

EXAMPLE 5

This example was the same as Example 4 except the solution heat treatment was eliminated before the block forging step and finish forging step. The resulting properties are shown in Table V.

TABLE V

| Orientation | Mechanical Properties UTS (ksi) | TYS (ksi) | Fracture Toughness (ksi sq.rt.in.) | % elong. |
|---|---|---|---|---|
| 1-L | 69.5 | 60.3 | LT-1 27.4 | 4.7 |
| 2-L | 69.0 | 58.5 | LT-2 23.9 | 6.2 |
| 1-ST | 64.4 | 60.0 | TL-1 24.2 | 3.1 |
| 2-ST | 67.1 | 60.3 | TL-2 20.7 | 3.1 |
| 3-ST | 64.4 | 59.4 | | 3.1 |
| 1-45 | 62.6 | 61.9 | 1-45 24.5 | 3.1 |
| 2-45 | 63.9 | 60.4 | 2-45 22.2 | 3.1 |

It will be noted from the results in Tables I and IV that these steps provided low levels of anisotropy and that Examples 2, 3 and 5 had higher levels of anisotropy.

EXAMPLE 6

This example was the same as Example 1 except the ingot was machined and forged without extruding. The resulting properties are shown in Table VI. It will be noted that the properties show low anisotropy while maintaining good strength levels.

TABLE VI

| Orientation | Mechanical Properties UTS (ksi) | TYS (ksi) | Fracture Toughness (ksi sq.rt.in.) | % elong. |
|---|---|---|---|---|
| 1-L | 80.2 | 71.6 | LT-1 16.7 | 3.1 |
| 2-L | 78.8 | 73.0 | LT-2 15.9 | 2.8 |
| 1-ST | 76.3 | 66.8 | TL-1 19.9 | 5.0 |
| 2-ST | 75.6 | 67.2 | TL-2 19.8 | 3.5 |
| 3-ST | 74.6 | 67.6 | | 4.4 |
| 1-45 | 74.2 | 66.0 | 1-45 19.3 | 2.8 |
| 2-45 | 73.5 | 66.2 | 2-45 19.0 | 3.0 |

While the invention has been described in terms of preferred embodiments, the claims appended hereto are intended to encompass other embodiments which fall within the spirit of the invention.

What is claimed is:

1. A process suitable for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a product having a grain structure suitable for forging;

(c) subjecting said preformed product to a forging operation in a temperature range of 500° to 1000° F.;

(d) solution heat treating said forged product in a temperature range of 900° to 1050° F.; and (e) aging said forged product.

2. The process in accordance with claim 1 wherein the preformed product is subjected to solution heat treatment in a temperature range of 900° to 1050° F. prior to the forging step.

3. The process in accordance with claim 1 wherein the forged product is subjected to solution heat treatment in a temperature range of 900° to 1050° F. followed by a second forging operation.

4. The process in accordance with claim 1 wherein the forged product is ramp annealed by controlling the heat-up rate in a temperature range of 500° to 1000° F. to a rate of 3° to 500° F. per hour prior to solution heat treating.

5. A process suitable for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a product having a grain structure suitable for forging;

(c) subjecting said preformed product to a solution heat treatment in a temperature range of 900° to 1080° F. prior to forging;

(d) subjecting said preformed product to a forging operation in a temperature range of 600° to 1000° F. to provide a block forging;

(e) solution heat treating the block forging in a temperature range of 600° to 1080° F.;

(f) finish forging the block forging;

(g) ramp annealing the finished forging in a temperature range of 600° to 1000° F. at a rate of 3° to 500° F. per hour;

(h) solution heat treating said forged product in a temperature range of 900° to 1080° F.; and (i) aging said forged product.

6. The process in accordance with claim 1 wherein the preforming is extruding.

7. The process in accordance with claim 5 wherein the preforming is extruding.

8. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a preformed product having a grain structure suitable for forging;

(c) subjecting said preformed product to a block forging operation in a temperature range of 500° to 1000° F.;

(d) finish forging the block forging;

(e) ramp annealing the forging;

(f) solution heat treating said forged product in a temperature range of 900° to 1050° F.; and (g) aging said forged product to provide said recrystallized forged product.

9. The process in accordance with claim 8 wherein the finish forging is performed in a temperature range of 600° to 1000° F.

10. The process in accordance with claim 8 wherein the ramp annealing is carried out in a temperature range of 650° to 1020° F. and the temperature is raised at a rate in the range of 3° to 500° F. per hour.

11. The process in accordance with claim 8 wherein the preforming is extruding.

12. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a preformed product having a grain structure suitable for forging;

(c) ramp annealing the preformed product;

(d) subjecting the ramp annealed and preformed product to a forging operation in a temperature range of 600° to 1000° F.;

(e) solution heat treating said forged product in a temperature range of 900° to 1050° F.; and (f) aging said forged product.

13. The process in accordance with claim 12 wherein the extruded product is subjected to solution heat treatment in a temperature range of 900° to 1080° F. prior to the forging step.

14. The process in accordance with claim 12 wherein the forged product is subjected to solution heat treatment in a temperature range of 900° to 1050° F. followed by a second forging operation.

15. The process in accordance with claim 12 wherein the forged product is ramp annealed by controlling the heat-up rate in a temperature range of 600° to 1000° F. to a rate of 3° to 500° F. per hour prior to solution heat treating.

16. The process in accordance with claim 12 wherein the preforming is extruding.

17. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide an extruded product having a grain structure suitable for forging;

(c) ramp annealing said extruded product in a temperature range of 600° to 1000° F. at a rate of 3° to 500° F. per hour;

(d) quenching the annealed product;

(e) subjecting said product to a solution heat treatment in a temperature range of 600° to 1000° F.;

(f) block forging said product in a temperature range of 600° to 1000° F. to a block forged product;

(g) solution heat treating said block forged product in a temperature range of 600° to 1080° F.;

(h) finish forging the block forged product in a temperature range of 600° to 1000° F.;

(i) solution heat treating said forged product in a temperature range of 900° to 1080° F.; and (j) aging said forged product.

18. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, 0.2 to 4 wt. % Cu, 2.2 to 11 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a preformed product having a grain structure suitable for forging;

(c) subjecting said preformed product to a forging operation in a temperature range of 600° to 1000° F.;

(d) solution heat treating said forged product in a temperature range of 900° to 1050° F.; and (e) aging said forged product.

19. The process in accordance with claim 18 wherein Zn is in the range of 5.1 to 10 wt. %.

20. The process in accordance with claim 18 wherein Zn is in the range of 7.1 to 10 wt. %.

21. The process in accordance with claim 18 wherein Mn is in the range of 0.1 to 0.6 wt. %.

22. The process in accordance with claim 18 wherein Ag is in the range of 0.05 to 0.8 wt. %.

23. The process in accordance with claim 18 wherein In is in the range of 0.05 to 0.4 wt. %.

24. The process in accordance with claim 18 wherein preforming is extruding.

25. The process in accordance with claim 18 wherein the preformed product is subjected to solution heat treatment in a temperature range of 900° to 1050° F. prior to the forging step.

26. The process in accordance with claim 18 wherein the forged product is subjected to solution heat treatment in a temperature range of 900° to 1050° F. followed by a second forging operation.

27. The process in accordance with claim 18 wherein the forged product is ramp annealed by controlling the heat-up rate in a temperature range of 600° to 1000° F. to a rate of 3° to 500° F. per hour prior to solution heat treating.

28. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, 0.2 to 4 wt. % Cu, 5 to 10 wt. % Zn, 0.05 to 1 wt. % Mn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a preformed product having a grain structure suitable for forging;

(c) subjecting said preformed product to a solution heat treatment in a temperature range of 900° to 1050° F. prior to forging;

(d) subjecting said preformed product to a forging operation in a temperature range of 600° to 1000° F. to provide a block forging;

(e) solution heat treating the block forging in a temperature range of 600° to 1050° F.;

(f) finish forging the block forging;

(g) ramp annealing the finished forging in a temperature range of 600° to 1000° F. at a rate of 3° to 500° F. per hour;

(h) solution heat treating said forged product in a temperature range of 900° to 1050° F.; and (i) aging said forged product.

29. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, 0.2 to 4 wt. % Cu, 2.2 to 11 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a preformed product having a grain structure suitable for forging;

(c) subjecting said preformed product to a block forging operation in a temperature range of 600° to 1000° F.;

(d) finish forging the block forging;

(e) ramp annealing the forging;

(f) solution heat treating said forged product in a temperature range of 900° to 1080° F.; and (g) aging said forged product.

30. The process in accordance with claim 29 wherein the finish forging is performed in a temperature range of 600° to 1000° F.

31. The process in accordance with claim 29 wherein the ramp annealing is carried out in a temperature range of 650° to 1020° F. and the temperature is raised at a rate in the range of 3° to 500° F. per hour.

32. The process in accordance with claim 29 wherein Zn is in the range of 5.1 to 10 wt. %.

33. The process in accordance with claim 29 wherein Zn is in the range of 7.1 to 10 wt. %.

34. The process in accordance with claim 29 wherein Mn is in the range of 0.1 to 0.6 wt. %.

35. The process in accordance with claim 29 wherein Ag is in the range of 0.05 to 0.8 wt. %.

36. The process in accordance with claim 29 wherein In is in the range of 0.05 to 0.4 wt. %.

37. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, 0.2 to 4 wt. % Cu, 2.2 to 11 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) extruding said body to provide an extruded product having a grain structure suitable for forging;

(c) ramp annealing the extruded product;

(d) subjecting the ramp annealed and extruded product to a forging operation in a temperature range of 600° to 1000° F.;

(e) solution heat treating said forged product in a temperature range of 900° to 1050° F.; and (f) aging said forged product.

38. The process in accordance with claim 37 wherein the extruded product is subjected to solution heat treatment in a temperature range of 900° to 1080° F. prior to the forging step.

39. The process in accordance with claim 37 wherein the forged product is subjected to solution heat treatment in a temperature range of 900° to 1080° F. followed by a second forging operation.

40. The process in accordance with claim 37 wherein the forged product is ramp annealed by controlling the heat-up rate in a temperature range of 600° to 1000° F. to a rate of 3° to 500° F. per hour prior to solution heat treating.

41. A process for forming a recrystallized forged product having low anisotropy or an unrecrystallized forged product having high strength comprising:

(a) providing a body of a lithium-containing aluminum base alloy comprised of 0.2 to 5 wt. % Li, 0.05 to 6 wt. % Mg, 0.2 to 4 wt. % Cu, 5 to 10 wt. % Zn, 0.05 to 1 wt. % Mn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities;

(b) preforming said body to provide a preformed product having a grain structure suitable for forging;

(c) ramp annealing said preformed product in a temperature range of 600° to 1000° F. at a rate of 3° to 500° F. per hour;

(d) quenching the annealed product;

(e) subjecting said product to a solution heat treatment in a temperature range of 600° to 1000° F.;

(f) block forging said product in a temperature range of 600° to 1000° F. to a block forged product;

(g) solution heat treating said block forged product in a temperature range of 600° to 1080° F.;

(h) finish forging the block forged product in a temperature range of 600° to 1000° F.;

(i) solution heat treating said forged product in a temperature range of 900° to 1080° F.; and (j) aging said forged product.

42. In a method of producing forged spacecraft or aircraft components including aircraft wheels and frame members wherein an aluminum alloy is provided as an ingot, the improvement wherein said ingot is provided as an alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities, said forged component further being provided in the condition resulting from:

(a) preforming said body to provide a product having a grain structure suitable for forging;

(b) subjecting said preformed product to a forging operation in a temperature range of 600° to 1000° F.;

(c) solution heat treating said forged product in a temperature range of 900° to 1080° F.; and (d) aging said forged product.

43. In a method of producing forged spacecraft or aircraft components including aircraft wheels and frame members wherein an aluminum alloy is provided as an ingot, the improvement wherein said ingot is provided as an alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt %, the remainder aluminum and impurities, said forged component further being provided in the condition resulting from:

(a) preforming said body to provide a product having a grain structure suitable for forging;

(b) subjecting said preformed product to a solution heat treatment in a temperature range of 900° to 1080° F. prior to forging;

(c) subjecting said preformed product to a forging operation in a temperature range of 600° to 1000° F. to provide a block forging;

(d) solution heat treating the block forging in a temperature range of 600° to 1080° F.;

(e) finish forging the block forging;

(f) ramp annealing the finished forging in a temperature range of 600° to 1000° F. at a rate of 3° to 500° F. per hour;

(g) solution heat treating said forged product in a temperature range of 900° to 1080° F.; and (h) aging said forged product.

44. In a method of producing forged spacecraft or aircraft components including aircraft wheels and frame members wherein an aluminum alloy is provided as an ingot, the improvement wherein said ingot is provided as an alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities, said forged component further being provided in the condition resulting from:

(a) preforming said body to provide a preformed product having a grain structure suitable for forging;

(b) subjecting said preformed product to a block forging operation in a temperature range of 600° to 1000° F.;

(c) finish forging the block forging;

(d) ramp annealing the forging;

(e) solution heat treating said forged product in a temperature range of 900° to 1080° F.; and (f) aging said forged product.

45. In a method of producing forged spacecraft or aircraft components including aircraft wheels and frame members wherein an aluminum alloy is provided as an ingot, the improvement wherein said ingot is provided as an alloy comprised of 0.2 to 5 wt. % Li, 0.05 to 6 wt. % Mg, at least 2.45 wt. % Cu, 0.05 to 2 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities, said forged component further being provided in the condition resulting from:

(a) preforming said body to provide a preformed product having a grain structure suitable for forging;

(b) ramp annealing the preformed product;

(c) subjecting the ramp annealed and preformed product to a forging operation in a temperature range of 600° to 1000° F.;

(d) solution heat treating said forged product in a temperature range of 900° to 1050° F.; and (e) aging said forged product.

46. In a method of producing forged spacecraft or aircraft components including aircraft wheels and frame members wherein an aluminum alloy is provided as an ingot, the improvement wherein said ingot is provided as an alloy comprised of 0.2 to 5 wt. % Li, 0.05 to 6 wt. % Mg, 0.2 to 4 wt. % Cu, 2.2 to 11 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, said forged component further being provided in the condition resulting from:

(a) preforming said body to provide a preformed product having a grain structure suitable for forging;

(b) subjecting said preformed product to a forging operation in a temperature range of 600° to 1000° F.;

(c) solution heat treating said forged product in a temperature range of 900° to 1050° F.; and (d) aging said forged product to provide said forged product.

47. In a method of producing forged spacecraft or aircraft components including aircraft wheels and frame members wherein an aluminum alloy is provided as an ingot, the improvement wherein said ingot is provided as an alloy comprised of 0.2 to 5 wt. % Li, 0.05 to 6 wt. % Mg, 0.2 to 4 wt. % Cu, 2.2 to 11 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities, said forged component further being provided in the condition resulting from:

(a) preforming said body to provide a preformed product having a grain structure suitable for forging;

(b) subjecting said preformed product to a block forging operation in a temperature range of 600° to 1000° F.;

(c) finish forging the block forging;

(d) ramp annealing the forging;

(e) solution heat treating said forged product in a temperature range of 900° to 1080° F.; and (f) aging said forged product.

48. In a method of producing forged spacecraft or aircraft components including aircraft wheels and frame members wherein an aluminum alloy is provided as an ingot, the improvement wherein said ingot is provided as an alloy comprised of 0.2 to 5 wt. % Li, 0.05 to 6 wt. % Mg, 0.2 to 4 wt. % Cu, 2.2 to 11 wt. % Zn, 0.5 wt. % max. Fe, 0.5 wt. % max. Si, at least one of the elements selected from the group consisting of Cr, V, Sc, Hf, Mn, Ag, In, Ti, Ni, Fe and Zr, with Cr, V, Ti and Zr, when present, in the range of 0.01 to 0.2 wt. %, Mn, Ni, Fe and Ag, when present, in the range of 0.01 to 1 wt. % and Hf, Sc and In, when present, in the range of 0.01 to 0.5 wt. %, the remainder aluminum and impurities, said forged component further being provided in the condition resulting from:

(a) extruding said body to provide an extruded product having a grain structure suitable for forging;

(b) ramp annealing the extruded product;

(c) subjecting the ramp annealed and extruded product to a forging operation in a temperature range of 600° to 1000° F.;

(d) solution heat treating said forged product in a temperature range of 900° to 1050° F.; and (e) aging said forged product.

* * * * *

UNITED STATES PATENT AND TRADEMARK OFFICE

CERTIFICATE OF CORRECTION

PATENT NO. : 5,108,519

DATED : April 28, 1992

INVENTOR(S) : Kevin P. Armanie, G. William Kuhlman, Roberto J. Rioja and A.K. Chakrabarti It is certified that error appears in the above-identified patent and that said Letters Patent is hereby corrected as shown below:

Title page, item [22], change "June 15, 1990" to --June 25, 1990--.

Col. 1, line 23, after "toughness" insert --.--.

Signed and Sealed this

Fourteenth Day of September, 1993

Bruce Lehman

*Attest:*

BRUCE LEHMAN

*Attesting Officer*

*Commissioner of Patents and Trademarks*